US010422173B1

(12) United States Patent
Dekko et al.

(10) Patent No.: US 10,422,173 B1
(45) Date of Patent: Sep. 24, 2019

(54) INTERLOCK ASSEMBLIES FOR FENESTRATION SYSTEMS AND METHODS

(71) Applicant: Andersen Corporation, Bayport, MN (US)

(72) Inventors: Jon Dekko, Stillwater, MN (US); Duane Fier, Hudson, WI (US); John Flynn, Temecula, CA (US); Michael E. Schmidt, Coon Rapids, MN (US); Adam Richard Rietz, Lake St. Croix Beach, MN (US)

(73) Assignee: ANDERSEN CORPORATION, Bayport, MN (US)

( * ) Notice: Subject to any disclaimer, the term of this patent is extended or adjusted under 35 U.S.C. 154(b) by 0 days.

(21) Appl. No.: 15/861,937

(22) Filed: Jan. 4, 2018

Related U.S. Application Data

(60) Provisional application No. 62/443,052, filed on Jan. 6, 2017.

(51) Int. Cl.
*E05D 15/06* (2006.01)
*E06B 3/42* (2006.01)

(52) U.S. Cl.
CPC ..... *E05D 15/0686* (2013.01); *E05D 15/0691* (2013.01); *E06B 3/42* (2013.01)

(58) Field of Classification Search
CPC .... E05D 15/0686; E05D 15/0691; E06B 3/42
USPC ..... 52/205.5
See application file for complete search history.

(56) References Cited

U.S. PATENT DOCUMENTS 2,663,917 A * 12/1953 Peterson ..... E06B 3/9636 160/90
2,857,633 A * 10/1958 Bunker ..... E06B 7/22 24/293
2,962,773 A * 12/1960 Heller ..... E06B 3/4618 16/97
3,072,975 A * 1/1963 Burmeister ..... E04B 2/827 105/155
3,097,401 A * 7/1963 Riegelman ..... E05D 15/0669 16/100
3,225,393 A * 12/1965 Coller ..... E04C 2/384 16/105
3,442,052 A * 5/1969 Levine ..... E05D 15/0669 49/425
3,600,854 A * 8/1971 Dallaire ..... E04B 2/90 49/121
3,660,936 A * 5/1972 Bryson ..... E06B 3/4627 49/209
4,237,664 A 12/1980 Wilmes
4,288,887 A * 9/1981 Johnson ..... E05D 15/063 16/105
6,145,630 A * 11/2000 Friedman ..... B66B 13/08 187/313
6,381,911 B1 5/2002 Weiland
(Continued)

*Primary Examiner* — Jeanette E Chapman
(74) *Attorney, Agent, or Firm* — Mueting, Raasch & Gebhardt, P.A.

(57) ABSTRACT

Interlock assemblies for sliding fenestration systems that provide for adjustment of the position and/or shape of the interlock assemblies and methods of adjusting the position and/or shape of the interlock assemblies are described herein. The interlock assemblies for sliding fenestration systems may be adjusted after installation to accommodate changes in the position and/or shape of the sides of building opening on which a stationary interlock structure is mounted.

23 Claims, 10 Drawing Sheets

(56) References Cited

U.S. PATENT DOCUMENTS

| | | | | |
|---|---|---|---|---|
| 6,792,651 | B2 | 9/2004 | Weiland et al. | |
| 7,971,392 | B2 | 7/2011 | Seo | |
| 8,240,089 | B2 | 8/2012 | Lambertini | |
| 8,381,445 | B2 | 2/2013 | Hans | |
| 9,217,277 | B2 | 12/2015 | Hans | |
| 9,458,656 | B2 | 10/2016 | Mickelson et al. | |
| 2003/0201074 | A1* | 10/2003 | Schnoor | E06B 3/4636 160/90 |
| 2004/0163317 | A1* | 8/2004 | Reich | E05D 15/565 49/209 |
| 2009/0013605 | A1* | 1/2009 | Seo | E05D 15/565 49/279 |

* cited by examiner

INTERLOCK ASSEMBLIES FOR FENESTRATION SYSTEMS AND METHODS

RELATED APPLICATION

This application claims the benefit under 35 U.S.C. Section 119 of U.S. Provisional Patent Application Ser. No. 62/443,052 entitled "INTERLOCK ASSEMBLIES FOR FENESTRATION SYSTEMS AND METHODS" and filed on Jan. 6, 2017, which is incorporated herein by reference in its entirety.

This invention relates to interlock assemblies for sliding fenestration systems. The interlock assemblies are adjustable to compensate for changes in position and/or shape of the interlock structures on the building opening and/or on a sliding panel.

Fenestration systems including one or more sliding panels supported on a sill are used for opening and closing openings in building structures. Some fenestration systems that include only one sliding panel and have a raised sill on which the sliding panel is supported may be referred to as patio doors, sliding doors, gliding doors, etc., although some sliding fenestration systems may include window units having one or more sliding panels supported on a sill. Fenestration systems that include two or more sliding panels supported on a sill are sometimes referred to as multi-slide fenestration systems. Another variation of sliding fenestration systems includes liftslide fenestration systems in which one or more sliding panels are raised (i.e., lifted) from a sill onto rollers or carriages for movement between their open and closed positions and then lowered in place. Sliding panels in liftslide systems may provide advantages when lowered in their closed positions due to potential improvements in sealing to limit the passage of air and/or water around the sliding panels. In wider openings that require more than one sliding panel to close an opening, the sliding panels commonly slide past one another to form a stack of sliding panels to reduce the space needed to store the sliding panels in the open position.

Examples of some sliding fenestration systems (and/or components of such systems) may be described in, e.g., U.S. Pat. Nos. 4,237,664; 6,381,911; 6,792,651; 7,971,392; 8,240,089; 8,381,445; 9,217,277; and 9,458,656.

Some sliding fenestration units may be constructed such that one or more of the sliding panels are moved into a pocket formed in the building when in an open configuration such that the sliding panels are not visible when stored in a pocket.

The functioning of sliding panel fenestration units (such as, e.g., pocket doors) improves as the precision with which the fenestration units fit the building structure increases. While the fenestration units themselves can be manufactured to a high level of dimensional accuracy, the building structures into which they are installed may not be so precisely constructed. Lack of precision in the building structures themselves may be, e.g., due to the difficulty of achieving tight dimensional tolerances using routine construction methods, as well as the tendency of building structures to shift and move, thereby altering dimensions that may be important to the functioning of fenestration units installed in the building structures. For example, one common problem in building structures is the tendency of vertical walls to bow inwardly and/or outwardly either during construction or after completion of the building structure.

In some instances, large changes in building structure dimensions and angles may need to be accommodated by adjustments in the fenestration units installed in openings in the building structures. Typically, however, such adjustments have been difficult due to, e.g., to the lack of sufficient adjustment features in commercially available fenestration units. These problems become more acute in fenestration units having larger numbers of moving parts, such as, e.g., multi-panel sliding doors, in particular, multi-panel sliding pocket doors. Pocket doors may present additional servicing problems because the pockets into which the sliding panels move may not be readily accessible when the doors are open or closed.

SUMMARY

Interlock assemblies for sliding fenestration systems that provide for adjustment of the position and/or shape of the interlock assemblies and methods of adjusting the position and/or shape of the interlock assemblies are described herein.

In one or more embodiments, the interlock assemblies for sliding fenestration systems as described herein may be adjusted after installation to accommodate changes in the position and/or shape of the sides of building opening on which a stationary interlock structure is mounted. These changes in position and/or shape of the interlock structures mounted on the sides of building openings can, in one or more embodiments, prevent coupling of and/or result in less than optimal mating of the interlock structures with complementary interlock structures on sliding panels positioned along the sides of the building openings. For example, in one or more embodiments, the side of a building opening may bow inwardly and/or outwardly between its top and bottom edges, causing an interlock structure mounted thereon to deform.

In addition to changes in the position and/or shape of the sides of building opening on which a stationary interlock structure is mounted, the sliding panels that include complementary interlock structures meant to engage with the interlock structures mounted on the building opening may themselves warp or otherwise deform, thus changing the position and/or shape of the panel-mounted interlock structures. Adjustment of the stationary interlock structures as described herein (i.e., those mounted on the building at the opening) may, in one or more embodiments, assist in adapting to changes in the positions and/or shape of panel-mounted interlock structures.

In one or more embodiments of the interlock assemblies described herein, the interlock structure proximate the sill of the sliding fenestration system may be fixed in position, with the position of only one or more intermediate portions of the interlock structure being adjustable. In still other embodiments of the interlock assemblies described herein, the interlock structure proximate the head track of the sliding fenestration system may also be fixed in position. Fixing the position of interlock structures at the sill ends and, optionally, at the head track ends while providing for adjustment of one or more intermediate portions of the interlock structure may allow for adjustments to adapt to changes in the positions and/or shape of the building opening and/or panels while limiting the potential for negative impacts to movement of one or both ends of the interlock structures. In particular, one or both ends of the interlock structures may typically experience only limited or no change in position and/or shape due to their proximity to the sill or the head track of the sliding fenestration system.

One or more embodiments of interlock assemblies as described herein may include panel interlock members that include features configured to cooperate with the adjustment mechanisms to assist in moving and/or retaining intermediate portions of the panel interlock members such that distances between the portions of the interlock structure on the intermediate portions of the panel interlock member and the reference axis are different than a distance between the interlock structures and the reference axis proximate the sill ends of the panel interlock members.

When used in connection with sliding fenestration units that include a pocket for receiving a sliding panel, the adjustable interlock assemblies as described herein may be particularly useful because they may be adjusted without requiring removal of any sliding panels and/or other structural components of the fenestration units. Further, one or more embodiments of the interlock assemblies may be constructed such that the panel interlock members can be moved to a position in which the interlock structure on the panel interlock member cannot engage the interlock structure on a sliding panel such that the entire sliding panel can be moved out of the pocket to allow access to the sliding panel and/or the pocket.

Interlock assemblies as described herein are configured for installation along a side of a building opening as part of a sliding fenestration system that includes a sill positioned along a bottom of the building opening and a head track positioned along a top of the building opening. In one or more embodiments, the interlock assemblies include: a base member configured for fixed attachment along a first side of a building opening such that the base member position is fixed relative to the first side of the building opening and extends along a vertical reference axis between the sill end the head track of the sliding fenestration system; a panel interlock member configured for attachment to the base member, wherein the panel interlock member extends between a sill end proximate the sill of the sliding fenestration system and a header end proximate the head track of the sliding fenestration system, and wherein the panel interlock member comprises an interlock structure on a panel side of the panel interlock member, wherein the sill end of the panel interlock member is fixed in position relative to the reference axis; and an adjustment mechanism positioned at an intermediate location between the sill end and the header end of the panel interlock member, wherein the adjustment mechanism is configured to move and/or retain an intermediate portion of the panel interlock member relative to the base member in an adjustment direction transverse to the reference axis such that a distance between the interlock structure on the intermediate portion of the panel interlock member and the reference axis is different than a distance between the interlock structure and the reference axis proximate the sill end of the panel interlock member.

In one or more embodiments of the interlock assemblies described herein, the header end of the panel interlock member is fixed in position relative to the reference axis such that movement of the intermediate portion of the panel interlock member by the adjustment mechanism does not move the interlock structure at the header end of the panel interlock member relative to the reference axis.

In one or more embodiments of the interlock assemblies described herein, the adjustment mechanism is located proximate a midpoint of the panel interlock member. In one or more embodiments of the interlock assemblies described herein, the adjustment mechanism comprises a cam.

In one or more embodiments of the interlock assemblies described herein, the adjustment mechanism comprises a first adjustment mechanism, wherein the intermediate location comprises a first intermediate location, and wherein the intermediate portion of the panel interlock member comprises a first intermediate portion of the panel interlock member, and wherein the assembly further comprises a second adjustment mechanism positioned at a second intermediate location between the first intermediate location and the header end of the panel interlock member, wherein the second adjustment mechanism is configured to move and/or retain a second intermediate portion of the panel interlock member relative to the base member in an adjustment direction transverse to the reference axis such that a distance between the interlock structure on the second intermediate portion of the panel interlock member and the reference axis is different than a distance between the interlock structure and the reference axis proximate the sill end of the panel interlock member. In one or more embodiments, no intermediate location is located with 30% or less, 20% or less, or 10% or less of a length of the panel interlock member as measured from the sill end to the header end of the panel interlock member.

In one or more embodiments of the interlock assemblies described herein, the assembly further comprises a sill key positioned below the sill end of the panel interlock member, and wherein the sill key is fixed in position relative to the reference axis and the sill of the sliding fenestration assembly. In one or more embodiments, the sill key comprises a panel interlock member index feature, wherein a position of the sill end of the panel interlock member is fixed on the sill key by the panel interlock member index feature. In one or more embodiments, the base member is configured for fixed attachment around an outside corner at the first side of a building opening such that the base member position is fixed in position relative to the outside corner at the first side of the building opening, and wherein the sill key is configured for attachment around the outside corner at the first side of the building opening.

In one or more embodiments of the interlock assemblies described herein, the panel interlock member comprises weatherstripping located adjacent the interlock structure, and wherein the weatherstripping is configured to move with the intermediate portion of the panel interlock member in the adjustment direction transverse to the reference axis with the interlock structure on the intermediate portion.

In another aspect, one or more embodiments of methods of adjusting a panel interlock for a sliding fenestration system as described herein include: attaching a base member along a first side of a building opening such that the base member position is fixed in position relative to the first side of the building opening and extends along a vertical reference axis between a sill of the sliding fenestration system at a bottom of the building opening and a head track of the sliding fenestration system at a top of the building opening; attaching a panel interlock member to the base member, wherein the panel interlock member extends between a sill end proximate the sill of the sliding fenestration system and a header end proximate the head track of the sliding fenestration system, and wherein the panel interlock member comprises an interlock structure on a panel side of the panel interlock member; and moving an intermediate portion of the panel interlock member relative to the base member in an adjustment direction transverse to the reference axis such that the interlock structure on the intermediate portion of the panel interlock member moves toward or away from the reference axis while the sill end of the panel interlock member is fixed in position relative to the reference axis such that moving the intermediate portion of the panel interlock member does not move the interlock structure at the sill end of the panel interlock member relative to the reference axis.

In one or more embodiments of the methods described herein, moving the intermediate portion of the panel interlock member comprises adjusting an adjustment mechanism positioned within the intermediate portion of the panel interlock member.

In one or more embodiments of the methods described herein, the method further comprises attaching the header end of the panel interlock member in a fixed position relative to the reference axis such that movement of the intermediate portion of the panel interlock member by the adjustment mechanism does not move the interlock structure at the header end of the panel interlock member relative to the reference axis.

In one or more embodiments of the methods described herein, the intermediate portion of the panel interlock member comprises a first intermediate portion of the panel interlock member, and wherein the method further comprises moving a second intermediate portion of the panel interlock member relative to the base member in an adjustment direction transverse to the reference axis.

In one or more embodiments of the methods described herein, moving the intermediate portion of the panel interlock member comprises rotating a cam that acts on the panel interlock member. In one or more embodiments, rotating the cam comprises rotating the cam about a cam axis that is transverse to the reference axis and the adjustment direction.

In one or more embodiments of the methods described herein, the method further comprises positioning a sill key below the sill end of the panel interlock member, and wherein the sill key is fixed in position relative to the reference axis and the sill of the sliding fenestration assembly. In one or more embodiments, the method further comprises fixing a position of the sill end of the panel interlock member on the sill key using a panel interlock member index feature on the sill key. In one or more embodiments, the method further comprises locating the sill key between a bottom end of the base member and the bottom of the building opening. In one or more embodiments, the base member is fixedly attached around an outside corner at the first side of a building opening such that the base member position is fixed in position relative to the outside corner at the first side of the building opening, and wherein the sill key is attached proximate the outside corner at the first side of the building opening.

In one or more embodiments of the methods described herein, the method further comprises moving the panel interlock member along the adjustment direction such that the interlock structure at the sill end, the header end, and in the intermediate portion all move away from the sill and the head track, wherein the interlock structure on the panel interlock member is positioned such that the interlock structure on the panel interlock member cannot engage an interlock structure on a moving panel of the sliding fenestration system. In one or more embodiments, the panel interlock member remains attached to the base member after being positioned such that the interlock structure on the panel interlock member cannot engage an interlock structure on a moving panel of the sliding fenestration system. In one or more embodiments, the base member remains fixed in position when moving the panel interlock member along the adjustment direction such that the interlock structure at the sill end, the header end, and in the intermediate portion all move away from the sill and the head track, wherein the interlock structure on the panel interlock member is positioned such that the interlock structure on the panel interlock member cannot engage an interlock structure on a moving panel of the sliding fenestration system.

Where used herein, the terms "top" and "bottom" are used for reference relative to each other when the interlock assemblies for sliding fenestration systems described herein are properly installed in a building opening.

Where used herein, the terms "exterior" and "interior" are used in a relative sense, e.g., an exterior side and an interior side of a sliding fenestration system and any of its components describe opposite sides of the sliding fenestration system and any of its components. In other words, an exterior side could be found within the interior of a building or other structure that would conventionally define an interior and an exterior, while an interior side could be found outside of a building or other structure that would conventionally define an interior and an exterior. With respect to the illustrative embodiments described herein, the exterior and interior sides of the sliding fenestration systems and any components thereof would be found on opposite ends along the y-axis of the Cartesian coordinate systems provided in the figures.

The above summary is not intended to describe each embodiment or every implementation of the interlock assemblies for sliding fenestration systems and/or methods as described herein. Rather, a more complete understanding of the invention will become apparent and appreciated by reference to the following Description of Illustrative Embodiment and claims in view of the accompanying figures of the drawing.

BRIEF DESCRIPTIONS OF THE DRAWING

Figure 3:
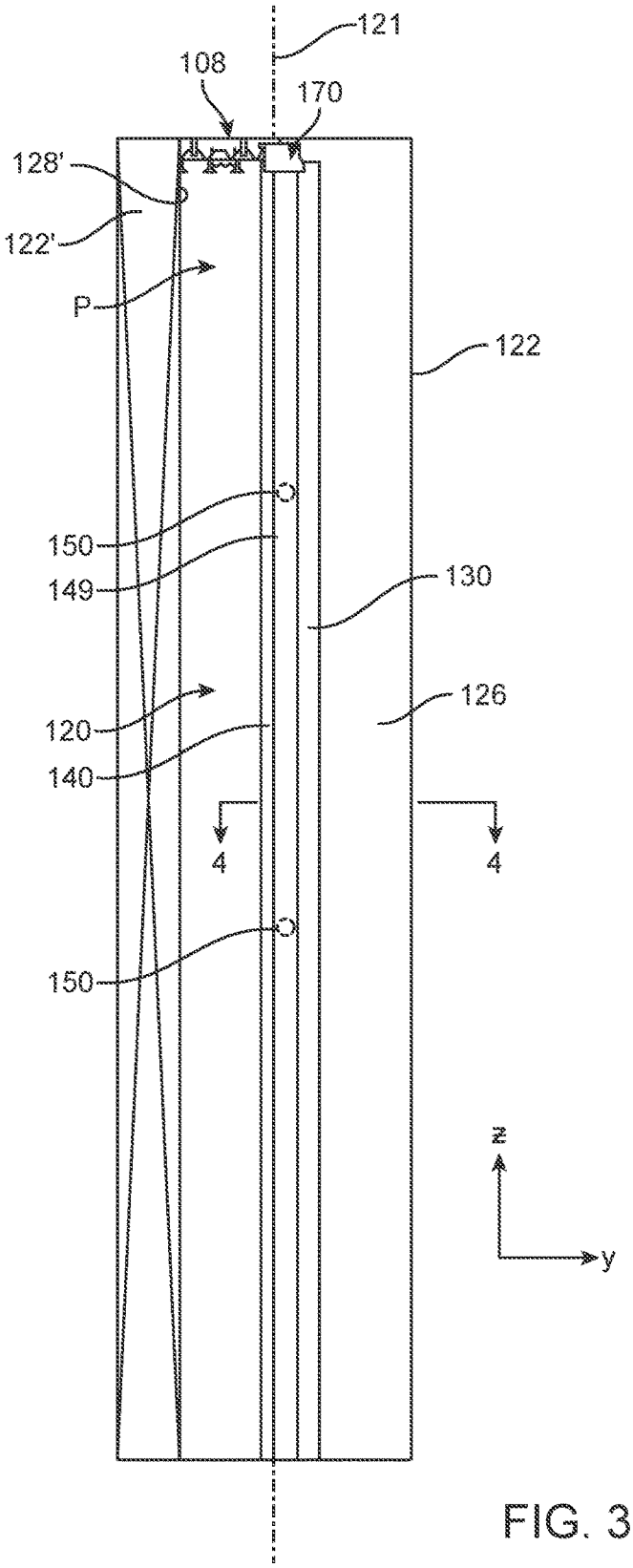
FIG. 3 depicts the pocket of the sliding fenestration system of FIGS. 1-2 after removal of the sliding panels (the view of FIG. 3 is taken along the x-axis as illustrated by line 3-3 in FIG. 1).
Figure 4:
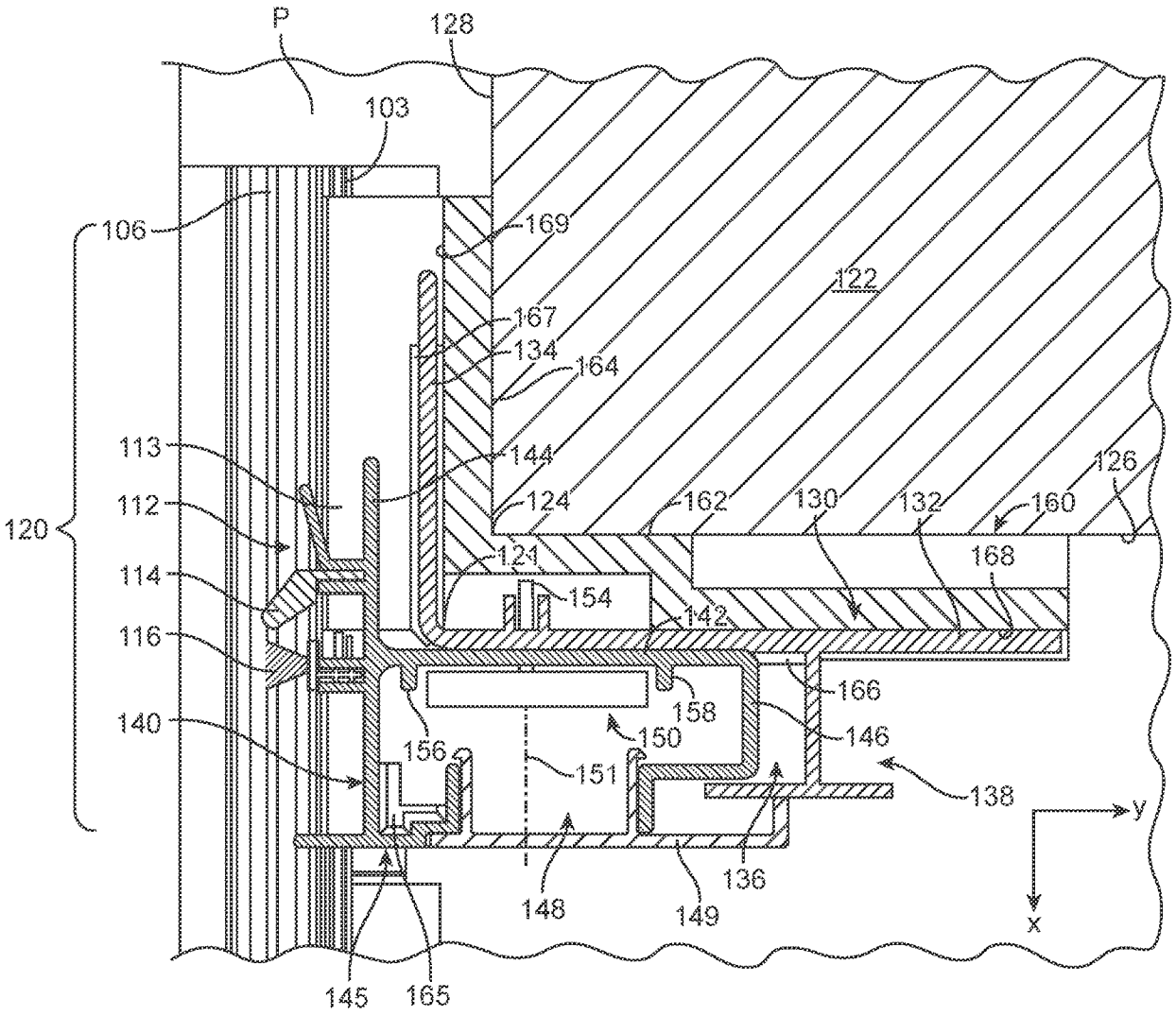

FIG. 4 is an enlarged view of the interlock assembly of FIG. 3 taken along line 4-4 in FIG. 3 (the wall 122, base member 130, panel interlock member 140, and cover panel 149 are depicted in cross-section).

Figure 5:
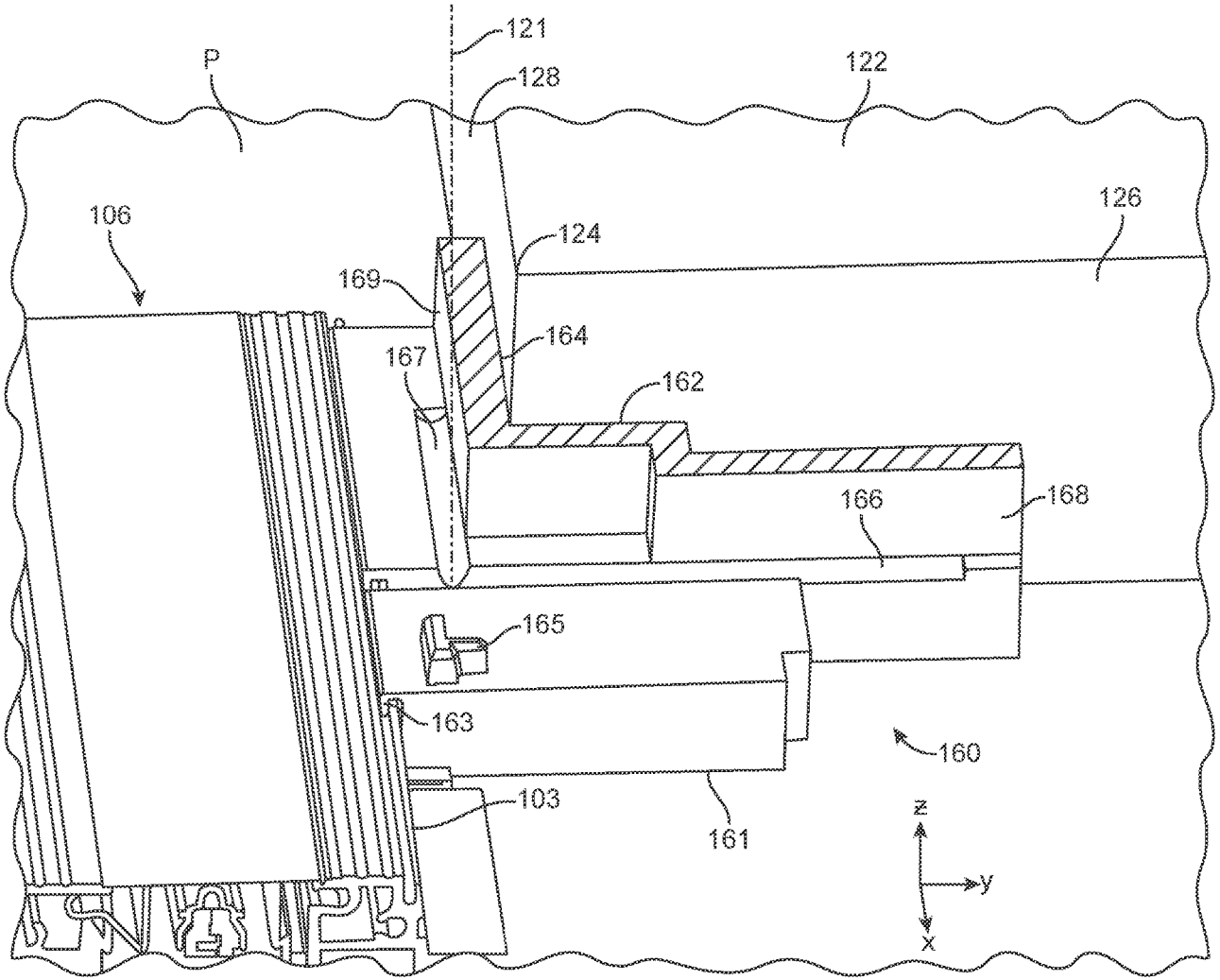

FIG. 5 is an enlarged perspective view of the illustrative embodiment of sill key 160 at the sill end of the interlock assembly of FIGS. 3-4 that may be used in connection with one or more embodiments of interlock assemblies as described herein.

Figure 6:
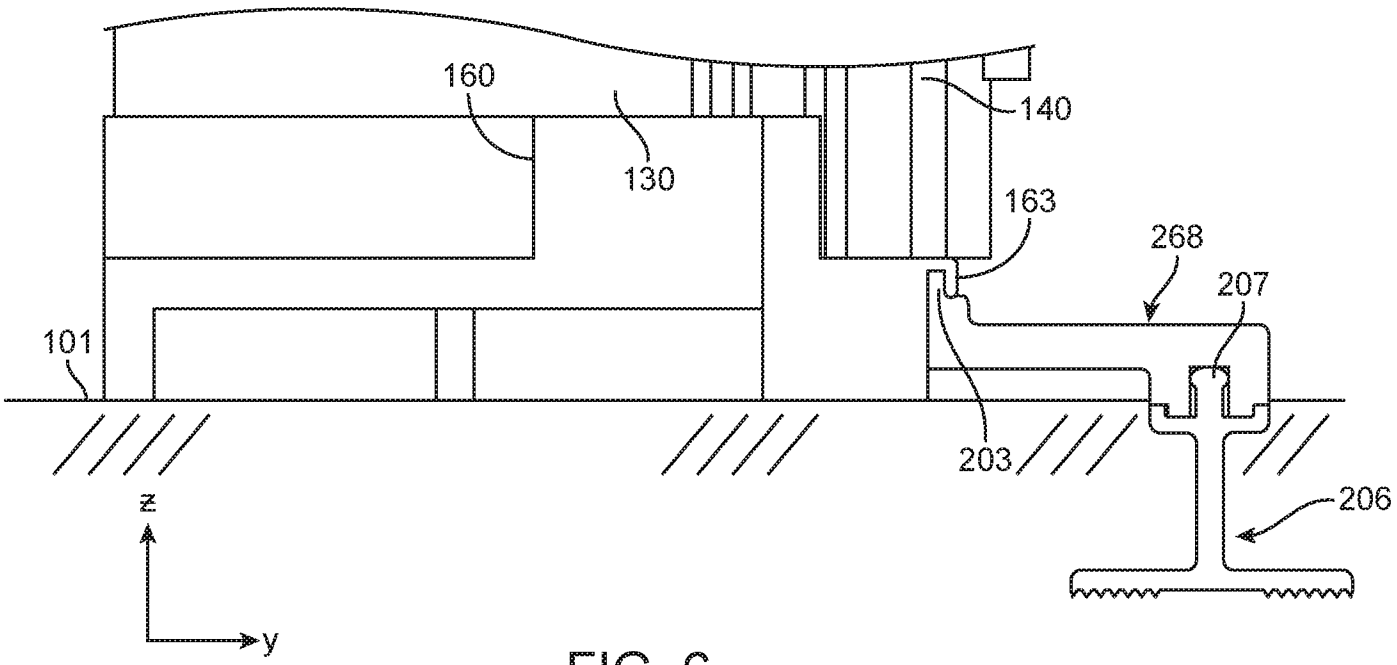

FIG. 6 depicts one illustrative embodiment of a positioning mechanism that may be used to align a sill key 160 of one or more embodiments of interlock assemblies with respect to a track 207 of a sill 206 as described herein.

Figure 7:
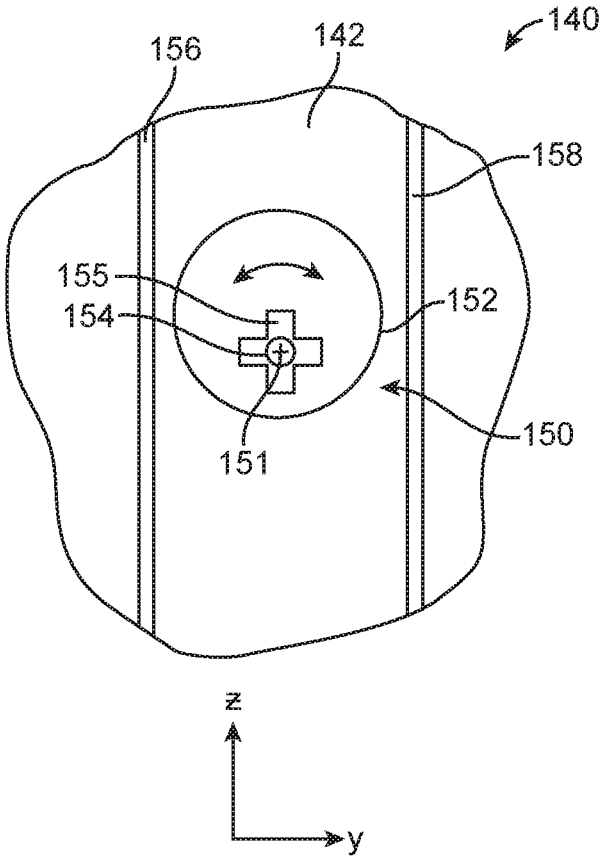

FIG. 7 depicts one illustrative embodiment of an adjustment mechanism (e.g., an adjustment mechanism 150 as seen in FIGS. 3 and 4) in the form of a cam that may be used in one or more embodiments of interlock assemblies as described herein.

Figure 8:
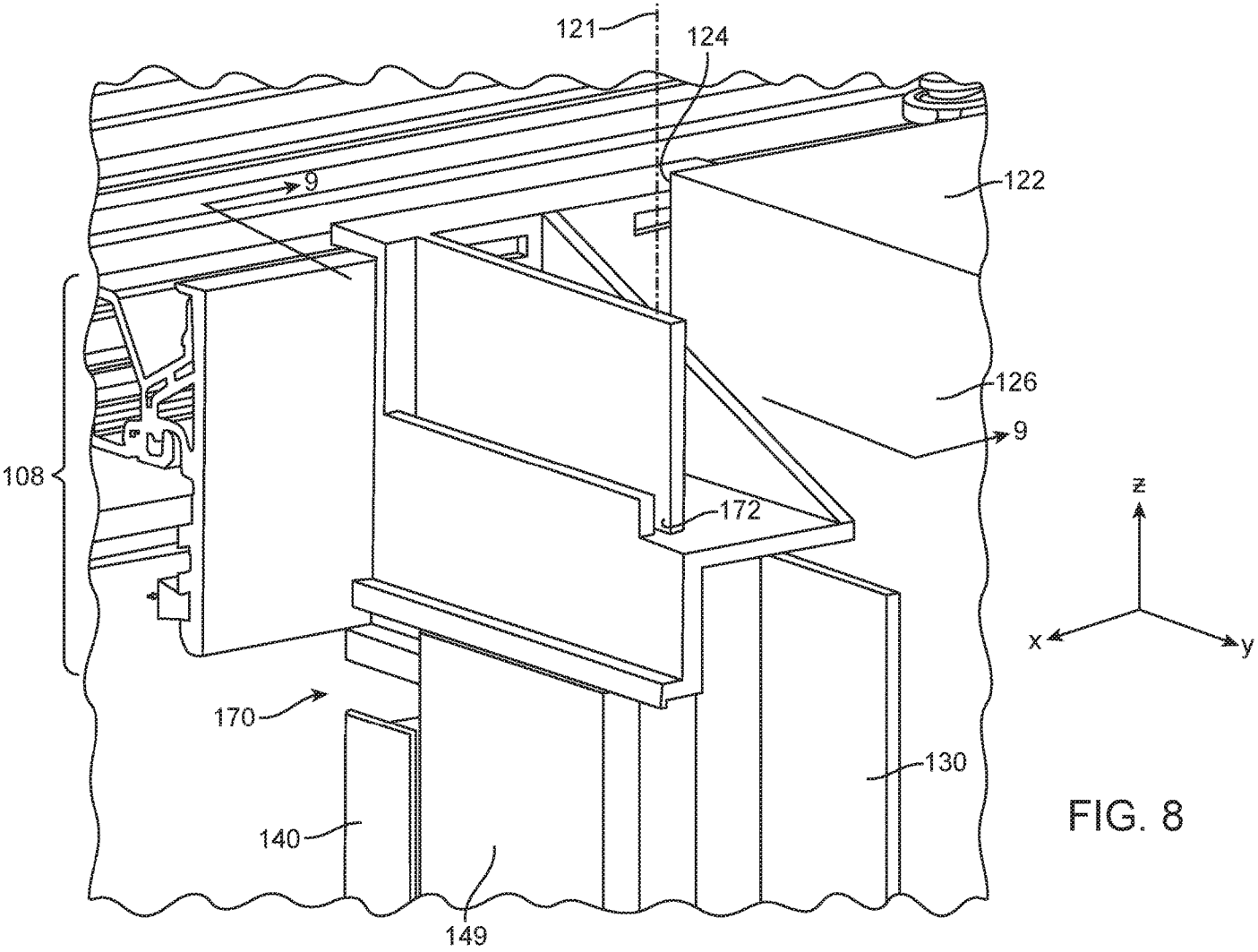

FIG. 8 is a perspective view of one illustrative embodiment of a head key 170 that may be used at the head end of an interlock assembly including a base member 130, panel interlock member 140, and cover panel 149 in connection with one or more embodiments of interlock assemblies as described herein.

Figure 9:
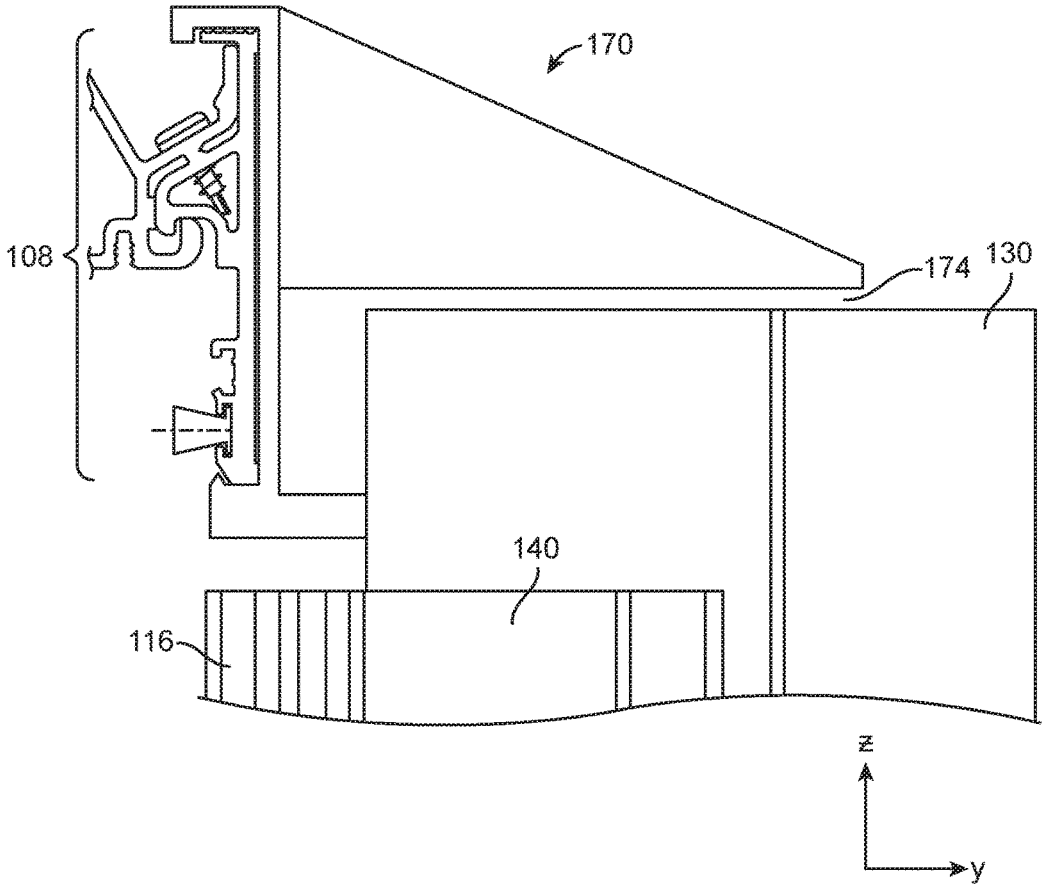

FIG. 9 is an enlarged partial cross-sectional view of FIG. 8 taken along line 9-9 in FIG. 8.

Figure 10:
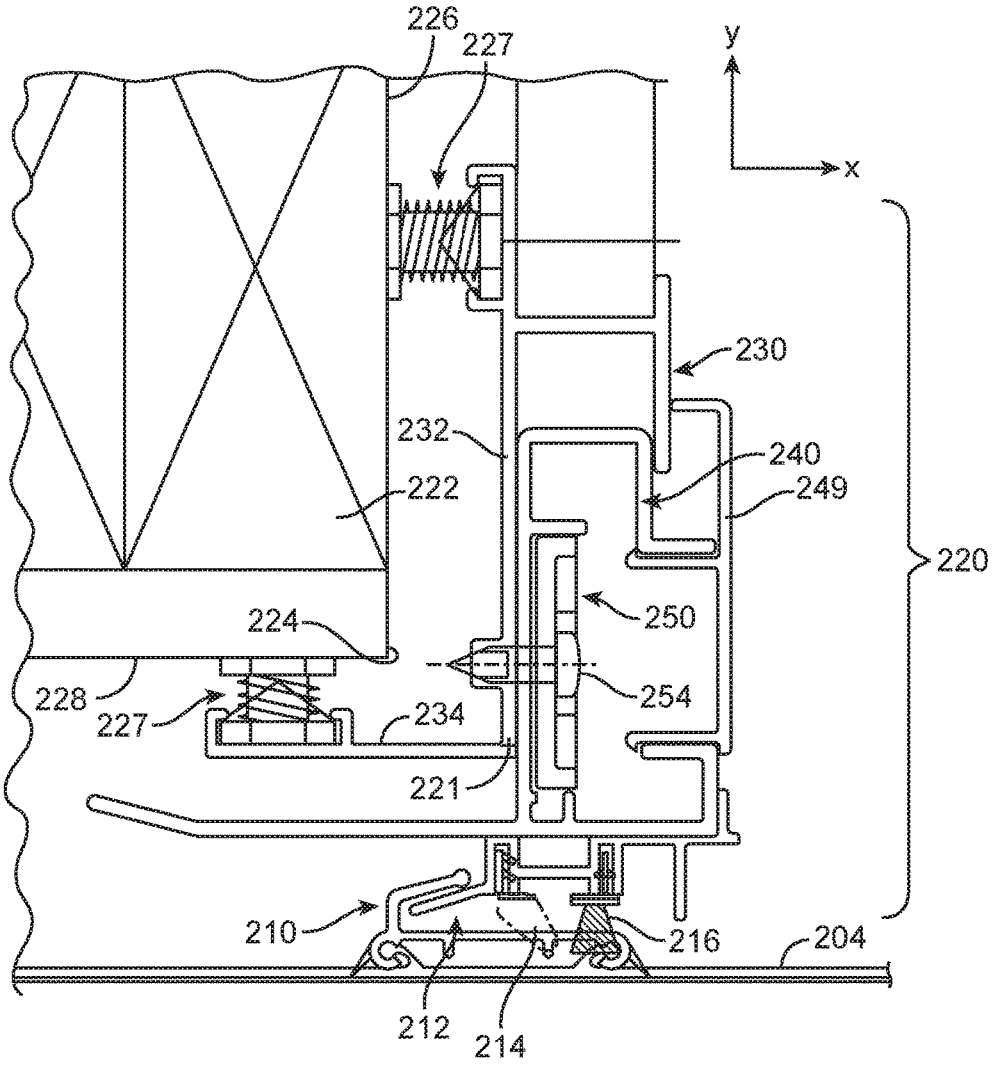

FIG. 10 is a cross-sectional view of one alternative illustrative embodiment of an interlock assembly including jack screws 227 to adjust the position of base member 230 relative to the wall surfaces 226 and 228 forming outside corner 224 as described herein that may be used with one or more embodiments of a sliding fenestration system.

For reference, each of the figures includes Cartesian coordinate system axes to assist in description of the various components of the interlock assemblies and sliding fenestration systems between the different figures as described herein.

DETAILED DESCRIPTION

In the following description, reference is made to the accompanying figures of the drawing which form a part hereof, and in which are shown, by way of illustration, specific embodiments. It is to be understood that other embodiments may be utilized and changes may be made without departing from the scope of the present invention.

Figure 1:
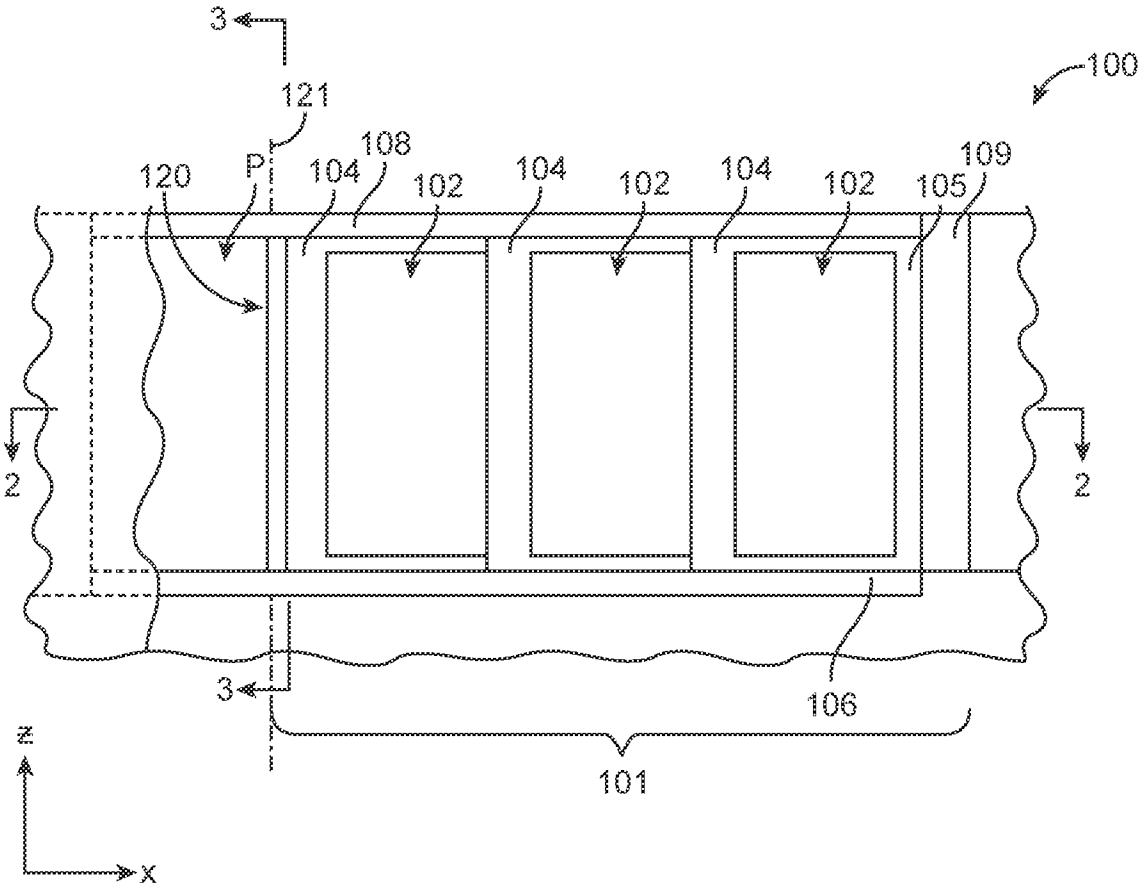
FIG. 1 depicts one embodiment of a sliding fenestration system including a pocket and one illustrative embodiment of an interlock assembly as described herein.
Figure 2:
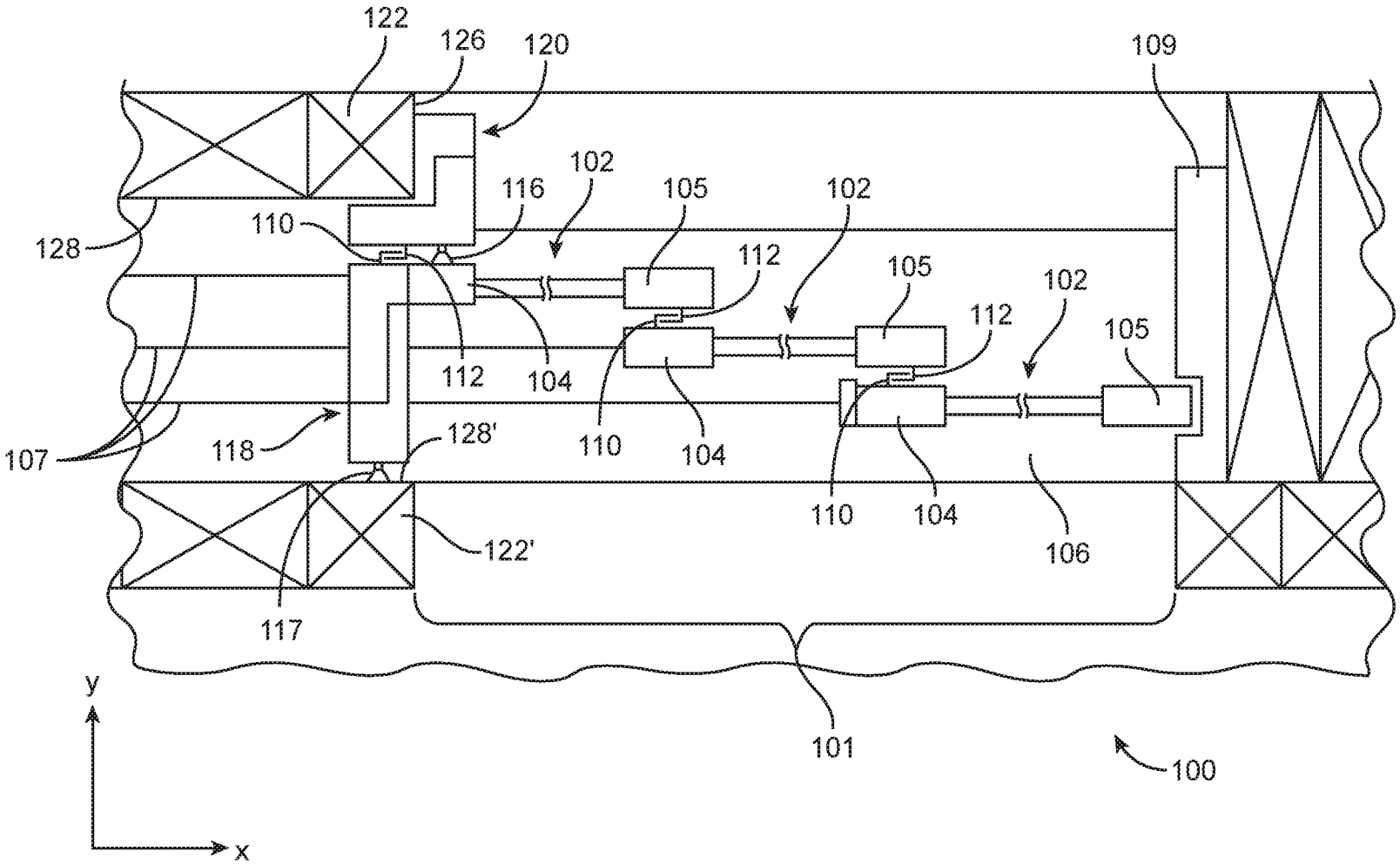
FIG. 2 is cross-sectional view of the sliding fenestration system of FIG. 1 taken along line 2-2 in FIG. 1.

One illustrative embodiment of a sliding fenestration system incorporating one illustrative embodiment of an interlock assembly as described herein is depicted in FIGS. 1 and 2. The sliding fenestration system 100 includes, in one or more embodiments, sliding panels 102 that move between a sill 106 and a head track 108 across a building opening 101. In FIGS. 1-2, the sliding fenestration system 100 is shown with the sliding panels 102 in their closed configuration such that the building opening 101 is closed by the panels 102.

Although the sliding fenestration system 100 depicted in FIGS. 1-2 includes three panels, one or more alternative embodiments of sliding fenestration systems that may include one or more embodiments of interlock assemblies as described herein may include as few as one panel, two panels, or four or more panels depending on the size of the building opening and/or the relative sizes of the panels located in the frame of the sliding fenestration system. Furthermore, although the depicted panels all have the same size, one or more alternative embodiments of sliding fenestration systems may include panels having different sizes.

In the closed configuration, the rightmost sliding panel 102 meets the right side jamb 109 of the sliding fenestration system 100 to close the right side of the building opening 101. The sliding fenestration system 100 also includes a pocket P located at one side of the building opening 101. Panels 102 may be moved along tracks 107 in sill 106 such that, when in the open configuration, the panels 102 are located within pocket P. The leftmost sliding panel 102 closes the left side of the building opening 101 as defined by the opening into the pocket P which is formed between outer wall 122 and inner wall 122'. In particular, the pocket P is formed by wall surfaces 128 and 128', each of which face the interior of the pocket P of the sliding fenestration system 100 depicted in FIGS. 1-2.

Each of the sliding panels 102 includes a trailing stile 104 and a leading stile 105, with the leading stiles 105 moving across building opening 101 along the front edge of each of the panels 102 when the panels 102 are moved from the pocket P into their closed configurations. The trailing stiles 104 move across a portion of the building opening 101 along the trailing edge of each of the panels 102 when the panels 102 are moved from the pocket P into their closed configurations.

In one or more embodiments of sliding fenestration systems as described herein, one or both of the leading and trailing stiles include interlock structures that are configured to interlock with each other to move panels 102 across the building opening 101 when being moved from their open configuration (located in, e.g., pocket P) to their closed configuration. When seen in cross-sectional views, the interlock structures may take the form of a hook as seen in, e.g., FIG. 2. In particular, the trailing stile 104 of the rightmost panel 102 includes an interlock structure 110 while the leading stile 105 of the middle panel 102 includes an interlock structure 112. The interlock structures 110 and 112 may, in one or more embodiments, mate with each other to assist in moving the middle panel 102 from the pocket P to its closed position in building opening 101 as the rightmost panel 102 is moved to its closed position. In addition to assisting with movement of panels, interlock structures 110 and 112 may also serve to structurally tie the panels 102, more precisely, the adjacent stiles 104 and 105 of panels 102 such that the panels 102 resists separation forces along the y-axis that could allow for unwanted openings between adjacent stiles 104 and 105 of adjacent panels 102.

Similarly, the trailing stile 104 of the middle panel 102 includes an interlock structure 110 while the leading stile of the leftmost panel 102 includes an interlock structure 112. The interlock structures 110 and 112 may, in one or more embodiments, mate with each other to assist in moving the leftmost panel 102 from the pocket P to its closed position in building opening 101 as the rightmost panel 102 and middle panel 102 are moved to their closed positions. As noted above, the interlock structures 110 and 112 between the leftmost panel 102 and the middle panel 102 may also serve to structurally tie those panels together, more precisely, the adjacent stiles 104 and 105 of those panels 102, such that the leftmost panel 102 and the middle panel 102 resists separation forces along the y-axis that could allow for unwanted openings between the adjacent stiles 104 and 105 of the leftmost panel 102 and the middle panel 102.

In addition to including an interlock structure 112 on its leading stile 105, the leftmost panel 102 also includes an interlock structure 110 on its trailing stile 104. The interlock structure 110 on the trailing stile 104 of leftmost panel 102, however, does not mate with another interlock structure on a panel. Rather, the interlock structure 110 on trailing stile 104 of leftmost panel 102 mates with an interlock structure 112 located on interlock assembly 120 which is positioned on the left side of the building opening 101. In particular, the building in which sliding fenestration system 100 is located includes a pocket P along the left side of the building opening 101, with the pocket being formed between walls 122 and 122' which include, respectively, inner surfaces 128 and 128' that face each other across the pocket P in which sliding panels 102 are located when in their open configurations.

In one or more embodiments, the leftmost panel 102 (or the rightmost panel in sliding fenestration systems that include a pocket P located on the right side of the building opening in which they are installed) also includes an optional pocket panel 118 that occupies the gap between inner wall surface 128' and the trailing stile 104 of the leftmost panel 102 when the sliding panels 102 are in their open configuration. In one or more embodiments, the optional pocket panel 118 may also carry weatherstripping 117 or any other seal components required to close the gap between pocket panel 118 and interior wall surface 128'. In one or more embodiments, the pocket panel 118 may be removable from the trailing stile 104 of the leftmost panel 1022 allow access into pocket P when the sliding panels 102 are not located therein.

In addition to carrying interlock structure 112 which mates with interlock structure 110 on the trailing stile 104 of the leftmost panel 102, the interlock assembly 120 depicted in FIG. 2 may also include weatherstripping or a seal component 116 configured to form a seal with the trailing stile 104 of leftmost sliding panel 102 to limit the passage of air, water, insects, dirt, etc. through the gap formed between that trailing stile 104 and the interlock assembly 120.

FIG. 3 depicts the pocket of the sliding fenestration system of FIGS. 1-2 after removal of the sliding panels, with the view being taken along the x-axis into the interior of the pocket P (along line 3-3 in FIG. 1), while FIG. 4 is a view of the depicted illustrative embodiment of interlock assembly 120 taken along line 4-4 in FIG. 3 (the wall 122, base member 130, panel interlock member 140, and cover panel 149 are depicted in cross-section in FIG. 4, with the top surface of sill key 160 seen between wall 122 and base member 130).

Among the features of the depicted illustrative embodiment of interlock assembly 120 depicted in FIGS. 3 and 4 are the base member 130, and panel interlock member 140, and adjustment mechanisms 150 (two of which are depicted in FIG. 3 although one or more embodiments of interlock assemblies as described herein may include only one adjustment mechanism or three or more adjustment mechanisms if so desired). The wall 122, base member 130, panel interlock member 140, and cover panel 149 are all depicted in cross-section in FIG. 4 (with the cross-section being taken along line 4-4 in FIG. 3). Although not in cross-section, the top surface of sill key 160 is also depicted with cross-hatching to assist the reader with identifying that surface in the corresponding perspective view of FIG. 5. The adjustment mechanisms 150 depicted in FIG. 3 are illustrated in broken lines because they are, in the depicted embodiment, not visible due to the cover panel 149 attached to panel interlock member 140. Removal of cover panel 149 does, however, provide access to the adjustment mechanisms 150 without requiring disassembly or detachment of any structural components of the depicted illustrative embodiment of interlock assembly 120.

With reference to FIG. 3, the interlock assembly 120 is depicted as being mounted on wall 122 on a side of the pocket P opposite the interior surface 128' provided by wall 122'. The sill 106 of the depicted illustrative embodiment of sliding fenestration system 100 is located at the bottom of the pocket P as well as along the bottom of the building opening 101 in which the sliding fenestration system 100 is installed. Head track 108 is located at the top of the pocket P as well as along the top of the building opening 101 in which the sliding fenestration system 100 is installed.

The depicted illustrative embodiment of interlock assembly 120 also includes sill key 160 located at a sill end of the panel interlock member 140 proximate the sill 106, as well as a head key 170 located at a header end of the panel interlock member 140, both of which will be described in more detail herein.

The cross-sectional view depicted in FIG. 4 provides many details with respect to the depicted illustrative embodiment of interlock assembly 120. As noted herein, interlock assembly 120 includes a base member 130 as well as a panel interlock member 140. One or more adjustment mechanisms 150 may be provided at intermediate locations between the sill end and the header end of the panel interlock member 140.

In one or more embodiments, the base member 130 is configured for fixed attachment along a first side of the building opening in which the interlock assembly is located. In one or more embodiments, the base member 130 is fixed in position relative to the first side of the building opening 101 and extends between the sill 106 and the head track 108 of the illustrative embodiment of sliding fenestration system 100.

The depicted illustrative embodiment of base member 130 includes a first leg 132 and a second leg 134, where the first leg 132 and the second leg 134 are attached to each other along the length of the base member 130. In one or more embodiments, the legs 132 and 134 are oriented perpendicular to each other such that they follow the shape of an outside corner 124 located along the side of the building opening on which the interlock assembly 120 is mounted. In particular, the portion of wall 122 depicted in FIG. 4 includes surfaces 126 and 128 that meet at outside corner 124. First leg 132 of base member 130 faces surface 126 of wall 122, while second leg 134 of base member 130 can be described as facing surface 128 of wall 122.

In one or more embodiments of interlock assemblies used in sliding fenestration systems as described herein, the base member may define a reference axis that extends along the z-axis (i.e., the vertical direction). The position of the reference axis defined by a base member of an interlock assembly as described herein may be located at any selected position along base member because base member is fixed in position relative to the first side of the building opening in which the interlock assembly is located. In the depicted illustrative embodiment of base member 130 of interlock assembly 120, reference axis 121 is located at the junction between first and second legs 132 and 134 of base member 130 although, as discussed herein, reference axis 121 could be located anywhere along base member 130.

The depicted illustrative embodiment of base member 130 also includes an optional panel interlock channel 136 that is configured to receive a portion of the panel interlock member 140. A panel interlock channel 136 such as that depicted in FIG. 4, may assist in retaining the panel interlock member 140 in position along first leg 132 of base member 130 during, e.g., installation of the interlock assembly 120.

An optional trim channel 138 such as that depicted in connection with the depicted illustrative embodiment of base member 130 may also be provided in connection with base members of interlock assemblies as described herein. The trim channel 138 may, for example, receive siding or other trim pieces installed to provide a more finished and aesthetically pleasing appearance along the first side of the sliding fenestration system 100.

The cross-sectional view of FIG. 4 also depicts many features of the depicted illustrative embodiment of a panel interlock member that may be attached to a base member of one or more embodiments of interlock assemblies as described herein. The depicted illustrative embodiment of panel interlock member 140 includes a first wall 142 facing first leg 132 of base member 130 and a second wall 144 facing the second leg 134 of base member 130.

In one or more embodiments, the panel interlock member 140 may be provided in the form of a channel as depicted in FIG. 4, although such a channel formed may not be required in all embodiments. The depicted channel formed by panel interlock member 140 includes a trim aperture 148 into which trim panel 149 is inserted and attached to provide for a more finished and aesthetically pleasing appearance. The trim panel 149 may improve the appearance of the interlock assembly 120 by hiding the adjustment mechanisms 150 and other features located within the channel formed by panel interlock member 140.

In addition, the panel interlock member 140 includes, in the depicted illustrative embodiment, a positioning end 146 located within panel interlock channel 136, with the positioning end 146 and panel interlock channel 136 interacting to assist in retaining the panel interlock member 140 in position relative to the base member 130.

Panel interlock member 140 carries a number of other components of the interlock assemblies as described herein. In particular, panel interlock member 140 includes interlock structure 112 located on a panel side of the panel interlock member 140, where the panel side of the panel interlock member 140 faces away from the base member 130 and towards a panel located in, e.g., pocket P (it being noted that no panel is present in the view depicted in FIG. 4). In the depicted illustrative embodiment of panel interlock member 140, the illustrative embodiment of interlock structure 112 forms a channel 113 that is configured to capture a mating interlock structure on a stile of a sliding panel located in pocket P of a sliding fenestration system as described herein.

The depicted illustrative embodiment of panel interlock member 140 also carries weatherstripping 114 and 116, both of which are configured and positioned to act on the stile of a sliding panel located in pocket P to limit or prevent the infiltration of air, water, insects, dirt, etc. between panel interlock member 140 and a stile of a sliding panel positioned adjacent to the panel interlock member 140.

As discussed herein, the sill ends of panel interlock members of interlock assemblies as described herein are fixed in position relative to reference axis such that movement of any intermediate portion of the panel interlock member by, e.g., an adjustment mechanism, does not move the interlock structure at the sill end of the panel interlock member relative to the reference axis. In the illustrative embodiment of interlock assembly 120 including base member 130 and panel interlock member 140 which carries interlock structure 112, the sill end of the panel interlock member 140 is fixed in position relative to reference axis 121 using a sill key 160.

The depicted illustrative embodiment of sill key 160 is seen in both FIGS. 4 and 5. Sill key 160 includes a base 161 that rests on the bottom of the building opening and includes surfaces 162 and 164 that form an inside corner that receives outside corner 124 formed by wall 122 along the side of the building opening in which the sliding fenestration system described herein is installed. In particular, surface 162 of sill key 160 rests against surface 126 of wall 122 while surface 164 of sill key 160 rests against surface 128 of wall 122. The complementary arrangement of surfaces 162 and 164 with outside corner 124 formed by wall 122 may, in one or more embodiments, assist in proper positioning of the sill key 160.

More importantly, however, sill key 160 preferably positions the sill end of panel interlock member 140 relative to the tracks 107 (see, e.g., FIG. 2) on sill 106 on which sliding panels 102 move past interlock structure 112 (which, in sliding fenestration systems that include a pocket P, also corresponds to movement of the sliding panels into and out of the pocket P). Positioning of the interlock structure 112 on interlock assembly 120 relative to the tracks 107 of sill 106 is a relationship that needs to be controlled for proper interlocking between the interlock structures on the interlock assembly 120 and any panels carrying complementary interlock structures that mate with interlock structure 112 on interlock assembly 120.

The depicted illustrative embodiment of sill 106 includes a raised rib 103, while sill key 160 includes a slot 163 configured to receive the raised rib 103 such that the position of sill key 160 relative to the sill 106 is fixed relative to any tracks located on sill 106. Ideally, the position of sill 106 allows for positioning of surfaces 162 and 164 of sill key 160 to abut the outside corner 124 of wall 122 such that surfaces 162 and 164 rest against surfaces 126 and 128, respectively.

Although the depicted illustrative embodiment of sill key 160 and sill 106 include a slot 163 and raised rib 103 that interlock with each other to properly position sill key 160 relative to tracks 107 located on sill 106, any suitable structures for achieving a complementary or mating relationship between sill key 160 and sill 106 may be provided to achieve proper positioning of sill key 160 relative to tracks 107 of sill 106. Examples of one or more potential suitable alternative complementary or mating structures may include, e.g., pins/posts and complementary holes or apertures, etc.

In those instances where the position of sill 106 relative to the outside corner 124 of wall 122 does not allow for surfaces 162 and 164 of sill key 160 to rest against surfaces 126 and 128 forming outside corner 124 of wall 122 along the side of the building opening in which the interlock assembly 120 is installed when the sill key 160 is properly positioned with respect to the sill 106, the sill key 160 may be shimmed from surfaces 126 and/or 128 as needed to securely fix the position of sill key 160 with respect to both outside corner 124 and sill 106. Where possible, shimming may be avoided if the position of the surfaces 126 and/or 128 of wall 122 and/or sill 106 may be adjusted during installation of the interlock assembly 120. In many instances, however, positions of one or both of the sill 106 and wall 124 may be fixed prior to installation of the interlock assembly 120. In those instances, shimming may be required to sufficiently secure sill key 160 in position.

The depicted illustrative embodiment of sill 106 is in the form of a raised sill, i.e., a sill that rests on the surface of the bottom of a building opening into which a sliding fenestration system using interlock assembly 120 is installed. FIG. 6 depicts an alternative manner in which proper positioning of a sill key 160 may be achieved when the sill of a sliding fenestration system is recessed within the bottom of the building opening in which the sliding fenestration system is installed. Examples of sliding fenestration systems with recessed sills may be found in, e.g., U.S. Pat. No. 6,792,651 (Weiland et al.).

The illustrative embodiment of sill key 160 is depicted in FIG. 6 along with the sill ends of both base member 130 and panel interlock member 140. A recessed sill 206 is depicted within the bottom of building opening 101 and includes a track 207 on which a sliding panel moves past the interlock assembly 120 as discussed herein. The depicted illustrative embodiment of sill key 160 can, in one or more embodiments, be properly positioned with respect to track 207 of sill 206 using positioning fixture 268 that includes a raised rib 203 that mates with index feature 163 on sill key 160 and, further, includes a channel capable of receiving track 207. As a result, the use of positioning fixture 268 allows for proper positioning of sill key 160 relative to track 207 during installation of sill key 160 in a building opening for use in aligning other components of the interlock assembly 120 located above sill key 160. In one or more embodiments, positioning fixture 268 is then removed after sill key 160 and, optionally, the remaining components of interlock assembly 120 have been fixed in position. Although depicted in connection with a recessed sill 206, positioning fixtures that are removable may also be used in connection with sills that are not recessed such as, e.g., surface mounted sill 106 and others.

With sill key properly positioned relative to tracks on a sill of a sliding fenestration system with which interlock assemblies as described herein may be used, other components of the interlock assemblies can be properly positioned such that the interlock structure of the interlock assembly is properly positioned with respect to a sliding panel moving along a track on the sill. As depicted in the illustrative embodiment seen in FIGS. 4 and 5, sill key 160 may include features configured to align the base member 130 as well as the panel interlock member 140.

In particular, the depicted illustrative embodiment of sill key 160 may include surfaces 168 and 169 against which legs 132 and 134 of base member 130 rest when base member 130 is properly positioned on sill key 160. With the sill end of base member 130 properly aligned, it may be secured to sill key 160 and/or wall 122 near which sill key 160 is located using any suitable fastening technique, e.g., threaded fasteners, adhesives, etc.

Sill keys used in one or more embodiments of interlock assemblies as described herein may include one or more features configured to align the sill end of a panel interlock member with both tracks on a sill used in the sliding fenestration system, as well as with a base member to which the panel interlock member is attached as a part of the installation process of the interlock assembly. In the depicted illustrative embodiment of sill key 160, the index features used to align the sill end of the panel interlock member 140 with both tracks 107 on sill 106 as well as with base member 130 may take the form of a raised protrusion 165 that has a shape that is complementary to an alignment channel 145 on panel interlock member 140. In particular, the index feature 165 on sill key 160 and alignment channel 145 on panel interlock member fix the position of the sill end of panel interlock member 140 against movement along the x-axis and the y-axis.

Although the index feature 165 and complementary alignment channel 145 are configured to fix the position of the sill end of panel interlock member 140 along both the x-axis and the y-axis, one or more alternative embodiments of interlock assemblies that may be used in sliding fenestration systems as described herein may include separate index features, one of which may be configured to fix the position of the sill end of panel interlock member 140 along the x-axis and another index feature which may be configured to fix the position of the sill end of panel interlock member 140 along the y-axis.

Further, one or more alternative embodiments of sill keys used with interlock assemblies of sliding fenestration systems as described herein may include index features that do not protrude from a surface of the sill key 160. Rather, in one or more alternative embodiments, sill key 160 may include recessed features that mate with either protruding features on the sill end of panel interlock member 140 or that simply receive at least a portion of the sill end of panel interlock member 140 to fix its position on sill key 160.

The depicted illustrative embodiment of sill key 160 as depicted in FIGS. 4 and 5 also includes optional drain channels 166 and 167 that may be provided to channel water that passes underneath the base member 130 and/or panel interlock member 140 to the sill 106 which, in one or more embodiments, may include drain features. In one or more embodiments, the channels 166 and 167, if provided for drainage, may include an aperture located above the channel 163 that interlocks with sill 106 as seen in, e.g., both FIGS. 4 and 5. Channels 166 and 167 may also provide space for application of sealants such as, e.g., silicone, etc. beneath the base member 130 and/or panel interlock member 140 to seal the junctions between those components.

As discussed herein, the interlock assemblies for sliding fenestration systems include at least one adjustment mechanism positioned at an intermediate location between the sill end and the header end of the panel interlock member. The adjustment mechanism is configured to move an intermediate portion of the panel interlock member relative to the base member in an adjustment direction that is transverse to a vertical reference axis (e.g., reference axis 121 in FIGS. 3-5). Movement of the intermediate portion of the panel interlock member in the adjustment direction moves the interlock structure on that intermediate portion of the panel interlock member toward or away from the reference axis such that the interlock structure and the panel interlock member can be deformed to, e.g., bow inwardly and/or outwardly to match the shape of the panel-mounted interlock structures.

In the depicted illustrative embodiment of interlock assembly 120, the adjustment mechanisms 150 may take the form of cams 152 that rotate about a cam axis 151 (the cam axis 151 being, in the depicted embodiment, off-center of the cam 152). The adjustment mechanisms 150 are positioned at intermediate locations between the sill end and the header end of the panel interlock member 140, where the sill end of the panel interlock member 140 is located proximate the sill of a sliding fenestration system (e.g., sill 106 as depicted in FIG. 3) and the header end of the panel interlock member 140 is located proximate the head track of a sliding fenestration system (e.g., head track 108 as depicted in FIG. 3).

Although the depicted illustrative embodiment of interlock assembly 120 is depicted as including two adjustment mechanisms 150 at two different intermediate locations along panel interlock member 140, one or more alternative embodiments of interlock assemblies as described herein may include only one adjustment mechanism at one intermediate location or three or more adjustment mechanisms at three or more different intermediate locations.

The intermediate locations at which adjustment mechanisms of interlock assemblies as described herein may be positioned are, in one or more embodiments, located away from the sill end and header end of the panel interlock member by a distance sufficient to allow for adjustment of a portion of the panel interlock member in an adjustment direction transverse to the reference axis as described herein. In one or more embodiments, the intermediate locations may be positioned away from the sill end and/or header end by a distance of 10% or more, 20% or more, or 30% or more of the overall length of the panel member as measured between its sill end and header end. In those embodiments in which only one adjustment mechanism is provided, the intermediate location at which the adjustment mechanism is positioned may be located proximate a midpoint of the panel interlock member as measured between its sill end and header end, where "proximate" as used in connection with the position of an adjustment mechanism relative to the midpoint of a panel interlock member means that the adjustment mechanism is located within 12 inches of a midpoint of the panel interlock member.

Interlock assemblies as described herein may include panel interlock members that include features configured to cooperate with the adjustment mechanisms to assist in moving and/or retaining intermediate portions of the panel interlock members as the panel interlock members are bowed inwardly and/or outwardly using the adjustment mechanisms such that distances between the portions of the interlock structure on the intermediate portions of the panel interlock member and the reference axis (e.g., reference axis 121 in FIGS. 3-5) are different than a distance between the interlock structures and the reference axis proximate the sill ends of the panel interlock members.

In the depicted illustrative embodiment of interlock assembly 120, panel interlock member 140 may include ribs 156 and 158 between which cam 152 is positioned. With reference to FIGS. 4 and 7, cam 152 may be rotated about its cam axis 151 such that cam 152 bears against rib 156 to move (e.g., bow) an intermediate portion of the panel interlock member 140 above and below the cam axis 151 to the left along the y-axis as depicted in FIG. 4. Alternatively, cam 152 may be rotated in an opposite direction about cam axis 151 such that cam 152 bears against rib 158 to move (e.g., bow) an intermediate portion of the panel interlock member 140 above and below the cam axis 151 to the right along the y-axis as depicted in FIGS. 4 and 7.

The depicted embodiment of cam 152 is secured to wall 142 of panel interlock member 140 using a threaded fastener 154 although any other suitable fastening technique that allows for rotation of cam 152 about a cam axis 151 offset from a center of the cam 152 may be used in place of a threaded fastener. One potential benefit of threaded fastener 154 is that it may also be used to secure cam 152 in a selected rotational position about cam axis 151 such that cam 152 also assists in retaining the intermediate portion of the panel interlock member 140 and its adjusted position. In one or more alternative embodiments, however, securing the intermediate portion of the panel interlock member 140 in an adjusted position may be performed by other techniques such as, e.g., driving additional threaded fasteners, nails, etc. through the wall 142 of panel interlock member 140.

The depicted illustrative embodiment of cam 152 also includes an optional keyed portion 155 into which a key may be inserted to provide more leverage for rotation of cam 152 about cam axis 151 where additional force is required to adjust the position of the intermediate portion of panel interlock member 140 located around cam axis 151.

Although the depicted illustrative embodiment of adjustment mechanisms 150 are in the form of cams 152, other mechanisms may be used to move an intermediate portion of the panel interlock member of an interlock assembly as described herein to move the interlock structure located on that intermediate portion of the panel interlock member.

For example, in one or more alternative embodiments, the adjustment mechanism may be in the form of, e.g., providing slots in the wall 142 of a panel interlock member 140 along with slots and clamping fasteners, e.g., threaded fasteners, that may be used to retain the intermediate portion of the panel interlock member 140 in an adjusted position. In one or more embodiments of such a variation, the force required to move the intermediate portion of the panel interlock member 140 to and adjusted position may be provided by articles or tools forced against or pulling on a portion of the panel interlock member to provide the necessary movement of the intermediate portion of the panel interlock member 140.

In one or more other alternative embodiments, the adjustment mechanism may include a jackscrew which could press against a fixed surface such as, e.g., a portion of the base member 130. Structure such as jackscrews could, in one or more embodiments, be used in combination with slots and clamping screws to provide the required adjustment of an intermediate portion of the panel interlock member.

Although the illustrative embodiments of adjustment mechanisms as described herein move an intermediate portion of the panel interlock member and in interlock structure located thereon in an adjustment direction that involves a sliding or linear motion, one or more alternative embodiments of panel interlock members and adjustment mechanisms used to move intermediate portions of those panel interlock members may involve, at least in part, rotational motion of an intermediate portion of the panel interlock member and associated interlock structure.

One or more embodiments of interlock assemblies used in sliding fenestration systems as described herein may include a panel interlock member having a header end that is fixed in position relative to a reference axis such that movement of one or more intermediate portions of the panel interlock member does not move the interlock structure located on the panel interlock member at the header end of the panel interlock member relative to the reference axis.

The depicted illustrative embodiment of interlock assembly 120 as depicted in FIGS. 3, 8, and 9 includes a head key 170 that may be used to fix the position of the header end of the panel interlock member 140. In particular, the head key 170 may be used to fix the position of the header end of the panel interlock member 140 relative to the head track 108 of the depicted embodiment of sliding fenestration system 100. Fixing the position of the header end of the panel interlock member 140 and the interlock structure 112 located thereon relative to the head track 108 preferably fixes the position of the interlock structure 112 relative to any tracks or guiding mechanisms located in head track 108.

Although in one or more embodiments, the head key 170 may include features that rest against one or both surfaces 126 and 128 of wall 122 that form outside corner 124 at the top of the building opening in which the sliding fenestration system is installed, such an arrangement is not required and may not occur where, for example, outside corner 124 is not plumb along its length.

As seen in the cross-sectional view of FIG. 9 (taken along line 9-9 in FIG. 8), the head key 170 may allow for expansion of the various components of the interlock assembly 120. In particular, the header ends of both base member 130 and panel interlock member 140 may terminate short of any surface of the head key 170 such that a gap 174 is provided between the head key 170 and the base member 130 and/or the panel member 140.

In one or more embodiments, the head key 170 may include slots or other features provided to assist in the attachment of fascia or other trim pieces to provide a finished appearance and/or close gaps along the top of the interlock assemblies used in sliding fenestration systems as described herein. Slot 172 as depicted in the illustrative embodiment of head key 170 provides only one example of such features and many more examples will be known to those of skill in the art.

Although the depicted illustrative embodiment of interlock assembly 120 includes a base member 130 and panel interlock member 140 that interface with a sill key 160 at the sill end of the interlock assembly, one or more alternative embodiments of interlock assemblies as described herein may not require the use of a sill key 160 to properly position the ends of the interlock assembly along the sill end had track of a sliding fenestration system.

One illustrative alternative embodiment of an interlock assembly 220 is depicted in a cross-sectional view in FIG. 10. The depicted illustrative embodiment of interlock assembly 220 includes an interlock structure 212 along with weatherstripping 214 and 216 provided to form a seal with a sliding panel moving past the interlock assembly 220. In particular, the depicted illustrative alternative embodiment of interlock assembly 220 includes interlock structure 212 that mates with interlock structure 210 on a stile 204 which may be found on a sliding panel moving past interlock assembly 220.

The depicted illustrative alternative embodiment of interlock assembly 220 includes a base member 230 and panel interlock member 240, as well as a trim plate 249. Further, the depicted illustrative embodiment of interlock assembly 220 includes an adjustment mechanism 250 which acts on panel interlock member 240 and is retained on the panel interlock member 240 by a fastener 254 in a manner similar to that described above in connection with adjustment mechanisms 150.

Base member 230 is positioned relative to wall 222 using any suitable technique, combination of techniques and/or structures. In the depicted illustrative embodiment, the base member 230 is positioned relative to the surfaces 226 and 228 forming outside corner 224 of wall 222 using jackscrews 227 that are positioned such that the legs 232 and 242 of base member 230 may be moved toward or away from their respective wall surfaces 226 and 228 to provide for proper positioning of base member 230 relative to a track of a sill on which a sliding panel including stile 204 carrying interlock structure 210 moves.

Also depicted in connection with this illustrative embodiment of interlock assembly 220 is a reference axis 221 that moves with base member 230 as it is adjusted in position relative to surfaces 226 and 228 of wall 222. As discussed herein, movement of base member 230 as well as panel interlock member 240 provides for adjustment of the position of those components relative to a track along which a sliding panel including stile 204 moves in a sliding fenestration system using interlock assembly 220.

Another optional feature of one or more embodiments of the interlock assemblies and one or more embodiments of the methods described herein includes the ability to pull the panel interlock member away from the sill and the head track such that the interlock member cannot engage with a complementary interlock member on a sliding panel. This feature may be useful to allow movement of the entire sliding panel positioned closest to the interlock assembly into the building opening. In other words, because the interlock structures are not engaged as the sliding panel moves into the opening, its progress into the building opening is not stopped and even the trailing stile (see, e.g., trailing stile 104 on the left-most panel 102 in FIG. 2) can move into the building opening in which the sliding fenestration system is installed. Movement of the entire sliding panel into the building opening can allow for better access to the surface past which the sliding panel moves and/or to a pocket of the sliding fenestration system (for those sliding fenestration systems that include a pocket) as well as improved access to the trailing stile and/or the entire sliding panel located closest to the interlock assembly.

With reference to, e.g., FIGS. 2-4, the panel interlock member 140 may be moved along the adjustment direction such that the interlock structure 112 at the sill end, the header end, and in the intermediate portion of the panel interlock member 140 all move away from the sill 106 and the head track 108 (along the y-axis). Such movement of the panel interlock member 140 moves the interlock structure 112 and the panel interlock member 140 into a position such that the interlock structure 112 on the panel interlock member 140 cannot engage an interlock structure 110 on a sliding panel 102 of the sliding fenestration system 100.

In one or more embodiments, the panel interlock member 140 remains attached to the base member 130 after being positioned such that the interlock structure 112 on the panel interlock member 140 cannot engage an interlock structure 110 on the sliding panel 102. As a result, movement of the panel interlock member 140 and the interlock structure 112 back into a position where it engages an interlock structure 110 on a sliding panel 102 is facilitated. In addition, the base member 130 remains, in one or more embodiments, fixed in position when moving the panel interlock member 140 to pull the interlock structure 112 on it out of engagement with the interlock structure 110 on the sliding panel 102 such that the overall positioning of the interlock assembly 120 relative to the sill 106 and head track 108 does not change.

One or more embodiments of the interlock assemblies described herein may include a sill key 160 having a raised protrusion 165 complementary to an alignment channel 145 on panel interlock member 140, with the raised protrusion 165 and the alignment channel 145 configured to align the sill end of the panel interlock member 140 with both tracks on a sill 106 and the base member 140 (see, e.g., FIGS. 4 and 5). In such embodiments, movement of the panel interlock member 140 vertically (i.e., along the z-axis) may be required before moving the sill end of the panel interlock member 140 away from the sill to prevent engagement of the interlock structures 112 and 110 on the panel interlock member 140 and a trailing stile 104 of a sliding panel 102. In those embodiments in which vertical movement is required, the header end of the panel interlock member 140 may preferably terminate short of the head key 170 as seen in, e.g., FIGS. 8 and 9 to allow for that vertical movement.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a system or method that "comprises" a list of elements (e.g., components or features or steps) is not necessarily limited to only those elements (or components or features or steps), but may include other elements (or components or features or steps) not expressly listed or inherent to the method.

As used herein, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

Further, the term "comprises" and variations thereof do not have a limiting meaning where these terms appear in the accompanying description. Moreover, "a," "an," "the," "at least one," and "one or more" are used interchangeably herein.

The complete disclosure of the patents, patent documents, and publications identified herein are incorporated by reference in their entirety as if each were individually incorporated. To the extent there is a conflict or discrepancy between this document and the disclosure in any such incorporated document, this document will control.

From the above disclosure of the general principles of the present invention and the preceding detailed description, those skilled in this art will readily comprehend the various modifications, re-arrangements and substitutions to which the present invention is susceptible, as well as the various advantages and benefits the present invention may provide. Therefore, the scope of the invention should be limited only by the following claims and equivalents thereof. In addition, it is understood to be within the scope of the present invention that the disclosed and claimed articles and methods may be useful in applications other than surgical procedures. Therefore, the scope of the invention may be broadened to include the use of the claimed and disclosed methods for such other applications.

The invention claimed is:

1. An interlock assembly for a sliding fenestration system configured for installation along a side of a building opening, the sliding fenestration system comprising a sill positioned along a bottom of the building opening and a head track positioned along a top of the building opening, the interlock assembly comprising:

a base member configured for fixed attachment along a first side of a building opening such that the base member position is fixed relative to the first side of the building opening and extends along a vertical reference axis between the sill end the head track of the sliding fenestration system;

a panel interlock member configured for attachment to the base member, wherein the panel interlock member extends between a sill end proximate the sill of the sliding fenestration system and a header end proximate the head track of the sliding fenestration system, and wherein the panel interlock member comprises an interlock structure on a panel side of the panel interlock member, wherein the sill end of the panel interlock member is fixed in position relative to the reference axis; and an adjustment mechanism positioned at an intermediate location between the sill end and the header end of the panel interlock member, wherein the adjustment mechanism is configured to move and/or retain an intermediate portion of the panel interlock member relative to the base member in an adjustment direction transverse to the reference axis such that a distance between the interlock structure on the intermediate portion of the panel interlock member and the reference axis is different than a distance between the interlock structure and the reference axis proximate the sill end of the panel interlock member.

2. An assembly according to claim 1, wherein the header end of the panel interlock member is fixed in position relative to the reference axis such that movement of the intermediate portion of the panel interlock member by the adjustment mechanism does not move the interlock structure at the header end of the panel interlock member relative to the reference axis.

3. An assembly according to claim 1, wherein the adjustment mechanism is located proximate a midpoint of the panel interlock member.

4. An assembly according to claim 1, wherein the adjustment mechanism comprises a cam.

5. An assembly according to claim 1, wherein the adjustment mechanism comprises a first adjustment mechanism, wherein the intermediate location comprises a first intermediate location, and wherein the intermediate portion of the panel interlock member comprises a first intermediate portion of the panel interlock member, and wherein the assembly further comprises a second adjustment mechanism positioned at a second intermediate location between the first intermediate location and the header end of the panel interlock member, wherein the second adjustment mechanism is configured to move and/or retain a second intermediate portion of the panel interlock member relative to the base member in an adjustment direction transverse to the reference axis such that a distance between the interlock structure on the second intermediate portion of the panel interlock member and the reference axis is different than a distance between the interlock structure and the reference axis proximate the sill end of the panel interlock member.

6. An assembly according to claim 5, wherein no intermediate location is located with 30% or less, 20% or less, or 10% or less of a length of the panel interlock member as measured from the sill end to the header end of the panel interlock member.

7. An assembly according to claim 1, wherein the assembly further comprises a sill key positioned below the sill end of the panel interlock member, and wherein the sill key is fixed in position relative to the reference axis and the sill of the sliding fenestration assembly.

8. An assembly according to claim 7, wherein the sill key comprises a panel interlock member index feature, wherein a position of the sill end of the panel interlock member is fixed on the sill key by the panel interlock member index feature.

9. An assembly according to claim 6, wherein the base member is configured for fixed attachment around an outside corner at the first side of a building opening such that the base member position is fixed in position relative to the outside corner at the first side of the building opening, and wherein the sill key is configured for attachment around the outside corner at the first side of the building opening.

10. An assembly according to claim 1, wherein the panel interlock member comprises weatherstripping located adjacent the interlock structure, and wherein the weatherstripping is configured to move with the intermediate portion of the panel interlock member in the adjustment direction transverse to the reference axis with the interlock structure on the intermediate portion.

11. A method of adjusting a panel interlock for a sliding fenestration system, the method comprising:

attaching a base member along a first side of a building opening such that the base member position is fixed in position relative to the first side of the building opening and extends along a vertical reference axis between a sill of the sliding fenestration system at a bottom of the building opening and a head track of the sliding fenestration system at a top of the building opening;

attaching a panel interlock member to the base member, wherein the panel interlock member extends between a sill end proximate the sill of the sliding fenestration system and a header end proximate the head track of the sliding fenestration system, and wherein the panel interlock member comprises an interlock structure on a panel side of the panel interlock member; and moving an intermediate portion of the panel interlock member relative to the base member in an adjustment direction transverse to the reference axis such that the interlock structure on the intermediate portion of the panel interlock member moves toward or away from the reference axis while the sill end of the panel interlock member is fixed in position relative to the reference axis such that moving the intermediate portion of the panel interlock member does not move the interlock structure at the sill end of the panel interlock member relative to the reference axis.

12. A method according to claim 11, wherein moving the intermediate portion of the panel interlock member comprises adjusting an adjustment mechanism positioned within the intermediate portion of the panel interlock member.

13. A method according to claim 11, wherein the method further comprises attaching the header end of the panel interlock member in a fixed position relative to the reference axis such that movement of the intermediate portion of the panel interlock member by the adjustment mechanism does not move the interlock structure at the header end of the panel interlock member relative to the reference axis.

14. A method according to claim 11, wherein the intermediate portion of the panel interlock member comprises a first intermediate portion of the panel interlock member, and wherein the method further comprises moving a second intermediate portion of the panel interlock member relative to the base member in an adjustment direction transverse to the reference axis.

15. A method according to claim 11, wherein moving the intermediate portion of the panel interlock member comprises rotating a cam that acts on the panel interlock member.

16. A method according to claim 15, wherein rotating the cam comprises rotating the cam about a cam axis that is transverse to the reference axis and the adjustment direction.

17. A method according to claim 11, wherein the method further comprises positioning a sill key below the sill end of the panel interlock member, and wherein the sill key is fixed in position relative to the reference axis and the sill of the sliding fenestration assembly.

18. A method according to claim 17, wherein the method further comprises fixing a position of the sill end of the panel interlock member on the sill key using a panel interlock member index feature on the sill key.

19. A method according to claim 17, wherein the method further comprises locating the sill key between a bottom end of the base member and the bottom of the building opening.

20. A method according to claim 17, wherein the base member is fixedly attached around an outside corner at the first side of a building opening such that the base member position is fixed in position relative to the outside corner at the first side of the building opening, and wherein the sill key is attached proximate the outside corner at the first side of the building opening.

21. A method according to claim 11, wherein the method further comprises moving the panel interlock member along the adjustment direction such that the interlock structure at the sill end, the header end, and in the intermediate portion all move away from the sill and the head track, wherein the interlock structure on the panel interlock member is positioned such that the interlock structure on the panel interlock member cannot engage an interlock structure on a moving panel of the sliding fenestration system.

22. A method according to claim 21, wherein the panel interlock member remains attached to the base member after being positioned such that the interlock structure on the panel interlock member cannot engage an interlock structure on a moving panel of the sliding fenestration system.

23. A method according to claim 21, wherein the base member remains fixed in position when moving the panel interlock member along the adjustment direction such that the interlock structure at the sill end, the header end, and in the intermediate portion all move away from the sill and the head track, wherein the interlock structure on the panel interlock member is positioned such that the interlock structure on the panel interlock member cannot engage an interlock structure on a moving panel of the sliding fenestration system.

* * * * *